US005543004A

United States Patent [19]

Tochacek et al.

[11] Patent Number: 5,543,004

[45] Date of Patent: Aug. 6, 1996

[54] STITCHBONDED ARTICLES AND METHOD OF MAKING SAME

[75] Inventors: Miroslav Tochacek, Woodbury; Donald M. Courteau, Maplewood; Vinu Patel, Oakdale, all of Minn.

[73] Assignee: Minnesota Mining and Manufacturing Company, St. Paul, Minn.

[21] Appl. No.: 204,480

[22] Filed: Mar. 2, 1994

Related U.S. Application Data

[62] Division of Ser. No. 13,718, Feb. 4, 1993, Pat. No. 5,310, 590.

[51] Int. Cl.[6] ..... B32B 7/08; B32B 31/26

[52] U.S. Cl. ..... 156/93; 156/308.2; 156/309.6

[58] Field of Search ..... 156/93, 148, 309.6, 156/308.2; 428/102, 284, 287, 296, 326; 66/192, 196, 202; 28/140, 143; 15/209 B, 209 C, 209 A

[56] References Cited

U.S. PATENT DOCUMENTS

| | | | |
|---|---|---|---|
| 2,890,579 | 6/1959 | Mauersberger . | |
| 3,030,786 | 4/1962 | Mauersberger . | |
| 3,148,999 | 9/1964 | Hoffman | 156/309.6 |
| 3,279,221 | 10/1966 | Gliksmann . | |
| 3,442,736 | 5/1969 | Duns | 156/309.6 |
| 3,464,876 | 9/1969 | Barb | 156/309.6 |
| 3,497,414 | 2/1970 | Blue . | |
| 3,697,347 | 10/1972 | Lehmann | 156/309.6 |
| 3,717,150 | 2/1973 | Schwartz . | |
| 3,837,943 | 9/1974 | Ploch et al. . | |
| 3,881,490 | 5/1975 | Whitehead et al. . | |
| 4,100,324 | 7/1978 | Anderson et al. . | |
| 4,154,884 | 5/1979 | Platt . | |
| 4,236,952 | 12/1980 | Krause et al. . | |
| 4,455,343 | 6/1984 | Temple . | |
| 4,675,226 | 6/1987 | Ott . | |
| 4,704,321 | 11/1987 | Zafiroglu . | |
| 4,737,394 | 4/1988 | Zafiroglu . | |
| 4,740,407 | 4/1988 | Schaefer et al. . | |
| 4,750,339 | 6/1988 | Simpson . | |
| 4,773,238 | 9/1988 | Zafiroglu . | |
| 4,876,128 | 10/1989 | Zafiroglu . | |
| 4,991,362 | 2/1991 | Heyer et al. . | |
| 5,025,596 | 6/1991 | Heyer et al. . | |
| 5,041,255 | 8/1991 | Zafiroglu . | |
| 5,080,951 | 1/1992 | Guthrie . | |
| 5,104,703 | 4/1992 | Rachman et al. | 428/35.6 |
| 5,213,588 | 5/1993 | Wong et al. | 51/293 |

FOREIGN PATENT DOCUMENTS

| | | |
|---|---|---|
| 162277 | 11/1976 | Czechoslovakia . |
| 193700 | 1/1982 | Czechoslovakia . |
| 1596823 | 9/1981 | European Pat. Off. . |
| 0073313 | 3/1983 | European Pat. Off. . |
| 1518375 | 2/1968 | France . |
| 2227318 | 8/1973 | Germany . |
| 59-106550 | 6/1984 | Japan . |
| 4161289 | 6/1992 | Japan . |
| 1421694 | 1/1976 | United Kingdom . |

OTHER PUBLICATIONS

Julius Parrella, "Nonwoven Technology and Wipers," presented at INDA–TEC 1989.

*Primary Examiner*—Daniel J. Stemmer
*Attorney, Agent, or Firm*—Gary L. Griswold; Walter N. Kirn; Daniel R. Pastirik

[57] ABSTRACT

Stitchbonded articles and methods of making same are presented. The articles may be either dual purpose wiping/scrubbing articles or only scrubbing articles. The articles may be constructed to have three dimensional scrubbing surfaces. Both the dual purpose articles and the scrubbing articles comprise thermoplastic nodules melt-bonded to the stitching yarn, and preferably to the fibers of an absorbent material, the nodules providing the primary scrubbing utility.

11 Claims, 4 Drawing Sheets

STITCHBONDED ARTICLES AND METHOD OF MAKING SAME

This is a division of application Ser. No. 08/013,718, filed Feb. 4, 1993, now U.S. Pat. No. 5,310,590, issued on May 10, 1994.

BACKGROUND OF THE INVENTION

1. Field of the Invention

This invention pertains to stitchbonded articles and to methods of producing such articles. Particularly, stitchbonded articles having absorbent and/or scrubbing abilities are described.

2. Related Art

Parella, J. C., "Nonwoven Technology and Wipers", paper presented at INDA-TEC 1989, presents a perceptive account of the nonwoven industry. Specifically, Parella describes and compares the four primary techniques that commercial manufacturers have focused on for producing absorbent wipes. In order of commercialization they are:

dry staple (carded, air laid, saturation or spray bonded webs made from textile fibers);

air-lay (fabric made by air laying and bonding cellulosic or synthetic pulp fibers);

melt blown (webs formed by in-line melt spinning of very fine fibers); and spunlace (fabrics produced by hydraulic entangling of fibers).

Parella compares these primarily using the "alphabet" of consumer driven requirements for wipes: "A" for absorbency; "B" for bulk density; "C" for consistency; "D" for durability; and "P" for price.

Dry staple nonwoven wipes were acceptable in terms of A and D, but P was a premium over 100% cellulosic paper wipes. Absorbent wipes made using the air-lay process generally met consumer needs for A, B, C, and P but fell short on improving D over already available dry staple nonwoven wipes. Despite this, product acceptance was almost immediate in industrial and consumer sectors. Fabrics made from melt blown fibers exhibited outstanding oil absorbency, and aqueous absorbency was acceptable. Adsorption or entrapment is the method of absorbency employed rather than absorption into the fiber or cellulose as in the use of the dry staple or air laying techniques. B, C, D, and P were adequate but not dramatically different from prior wipes. Spunlaced fabrics were said to be "the most complete nonwoven wiper seen to date" in terms of A, B, C, and D, and P was "within the range of acceptance given the performance characteristics."

Stitchbonding, as a method of bonding two fabrics together to form a durable, absorbent wipe, has apparently not received the amount of attention of the wipes industry as have the above mentioned techniques.

There are numerous stitchbonded materials which include thermoplastic material in some manner incorporated into the material. For example, U.S. Pat. No. 5,104,703 discloses a single layer nonwoven fabric that is a single layer batt formed of crosslapped fiber, having a structure compacted by needle tacking, and being thermally bonded by thermally setting a low melting thermoplastic material intermixed throughout the batt. The batt is stitched through. U.S. Pat. No. 4,740,407 describes a pile-like substrate comprising a textile carrier body consisting of fibers and having a rough surface on at least one side, being at least partially impregnated with a polymeric synthetic plastics-material having a foam-like condition. The substrate is ground on at least one impregnated surface such that the fibers of the carrier body protrude at least partially out of the substrate.

SUMMARY OF THE INVENTION

In accordance with the present invention, stitchbonded articles are presented, one embodiment being a dual function absorbent/scrubbing article comprising an absorbent fibrous sheet which is stitched using a stitch-through technique, at least one surface of the fibrous sheet having randomly shaped nodules of thermoplastic material melt-bonded thereto. As used herein the terms "dual use", "dual function", and "dual purpose" are used interchangeably, and mean that the article may be used as an absorbent article, a scrubbing article, or both. By the term "scrubbing article" is meant that the article is abrasive in nature but will not scratch surfaces having a Mhos hardness of 2 or greater.

The absorbent fibrous sheet may be oil and/or water absorbent and may comprise blown thermoplastic microfibers, wet or dry laid staple fibers, carded staple fibers, spun-laced fibers, or cellulosic pulp fibers. Preferably, the absorbent fibrous sheet comprises a nonwoven batt consisting essentially of cellulosic pulp fibers bonded together by an adhesive binder. The bonding of the fibers may be by thermoplastic powder bonding, thermoplastic fibers, or by spray bonding. Preferred is spray bonded batts, using acrylic latex-based adhesive binders. Preferably the batt has a basis weight of at least about 95 g/m$^2$ (gsm) per ply. The batt is stitchbonded, using a plain or tricot stitch, with a stitching yarn comprising at least one high temperature stable material, such as polyester.

In the final form of one dual function article embodiment of the invention the thermoplastic nodules are melt-bonded to the stitching yarn, and are also melt-bonded to at least a portion of the external surface(s) of the absorbent fibrous sheet. The thermoplastic nodules may be melt-bonded either to the "technical back-side", to the "technical face side", or to both sides of the articles.

In one class of preferred dual function article embodiments, a second absorbent layer is stitchbonded to the first absorbent layer on the surface opposite the thermoplastic nodules. The second layer may comprise materials selected from the group consisting of i) a second nonwoven batt consisting essentially of cellulosic pulp fibers bonded together by an adhesive binder, wherein the second batt may be the same or different from the first batt; and ii) a woven, nonwoven, or knitted layer of materials selected from the group consisting of viscose rayon, cotton, non-polyolefin synthetic fibers, and mixtures thereof.

The first (or more) absorbent layers are stitched through by stitches of yarn, preferably a plain or tricot stitch. A stitch density (number of stitches in the machine direction per 10 cm) ranging from about 15 to about 35 st/10 cm, and stitch gauge (number of stitch wales per 10 cm) ranging from about 10 to about 40, have been found to afford the articles with surprisingly good water absorbency properties (rate and absolute) and durability when used in conjunction with adhesive bonded cellulosic pulp fiber batts.

The thermoplastic nodules can be formed by any one of variety of methods. One preferred method comprises stitching together a fibrous absorbent sheet with a low weight, thin sheet of nonwoven polyolefin material, such as that known under the trade designation "RFX" from Amoco Chemical Company, Inc. Alternatively, a thin polyolefin film could be used. The low weight, thin nonwoven or film thermoplastic may have a weight ranging from about 3.5 to about 170 grams per square meter (gsm), more preferably from about 35 to about 70 gsm. The polyolefin material is then exposed to heat sufficient to melt the material so that it flows, generally conforming to the stitching yarn and absorbent sheet. The melted thermoplastic material reverts to a weakly cohesive material which breaks apart in the molten state to form a multiplicity of globules of molten thermoplastic material dispersed on the surface of the fibrous sheet and exposed stitching yarn. Upon cooling, nodules of hardened thermoplastic material form having various shapes and contours. If the stitching yarn comprises a component having a melting temperature low enough to melt under the influence of the applied heat, as in one preferred embodiment, thermoplastic nodules are generated from the stitching yarn also.

Thus, another aspect of the invention is a method of manufacturing stitchbonded dual purpose articles of the invention as herein described, wherein the method comprises:

(a) stitchbonding with a stitching yarn (preferably a bicomponent yarn having a thermoplastic component) at a stitch density and a stitch gauge a sheet of an absorbent material and a sheet of a thermoplastic material;

(b) subjecting the thermoplastic material to conditions sufficient to melt the thermoplastic material but insufficient to melt the absorbent material and at least one component of the stitching yarn; and (c) cooling the product of step (b) to a temperature sufficient to reharden the thermoplastic material, thus forming a scouring surface comprised of a plurality of nodules of said thermoplastic material melt-bonded to the sheet of absorbent material.

It was unexpected that the dual function articles of the invention could be obtained by stitchbonding together an absorbent sheet and a heat-shrinkable polymeric material, with only a slight decrease in water absorbency properties and a large increase in scrubbing power. Previously disposable items are rendered into multi-use items, reducing waste disposal problems. The appearance of articles of the invention can be modified to be more attractive by changing the colors of the stitching yarns and/or the layers used to make the articles. The stitchbonded articles of the invention can be further attached to other materials, such as cellulose and polyurethane sponge. Suitable attachment mechanisms include meltbonding and the use of adhesives.

As noted above, a stitching yarn comprising at least two compositionally different fibers, and thus of different heat stability, may be used. In these embodiments, the two compositionally different fibers are preferably melt-bonded to each other along at least a portion of their contact area, and at least a portion of the yarn is in turn melt-bonded to the outer surfaces of the absorbent layer. Nodules may also be generated from the lower heat stable component, as described previously.

The use of a stitching yarn having one component material which has the characteristic of shrinking upon application of heat and subsequent cooling may be used to control the degree of bulk of the dual purpose articles of the invention. For example, compositionally identical polyester filaments produced using different draw ratios will react differently to heating and cooling cycles, due to the difference in crystallinity of the polymers. Generally, the less oriented the polymer chains are after drawing, the less crystalline the polymer will be, translating into a higher degree of shrinkage.

As used herein "cellulosic pulp fibers" means cellulosic fibers, such as wood pulp fibers, having a length ranging from about 3 to about 5 mm, and diameter ranging from about 15 to about 40 micrometers (denier ranging from about 1 to about 5 dtex). Thus, these fibers are distinguished from staple or textile fibers (which generally have a length between about 2 and 9 cm) and continuous filaments. "Consisting essentially of nonwoven cellulosic pulp fibers" means that the batt contains zero or a de minimis amount of fibers which do not meet the definition of "pulp fibers".

One particularly preferred class of dual purpose articles of the invention are those wherein the second layer comprises a second batt of nonwoven cellulosic pulp fibers bonded together by an adhesive binder. Also preferred dual purpose articles within the invention are those wherein the second layer comprises viscose rayon fibers or cotton fibers.

Another aspect of the invention is a scrubbing material comprising interlocking stitches of one or more yarns, the yarn(s) having melt-bonded thereto a plurality of thermoplastic nodules. At least a portion of the yarn must have a melting temperature above that of the thermoplastic material which forms the nodules.

A further aspect of the invention is a method of making a scrubbing article, the method comprising the steps of:

(a) stitching with a stitching yarn at a stitch density and a stitch gauge a sheet of a material comprising a thermoplastic material, at least a portion of the stitching yarn having a melting temperature above the melting temperature of the thermoplastic material;

(b) subjecting the product of step (a) to conditions sufficient to melt the thermoplastic material but insufficient to melt at least one component of the stitching yarn; and (c) cooling the product of step (b) to temperatures sufficient to reharden and shrink the thermoplastic material, thus forming a scouring article comprised of nodules of thermoplastic material melt-bonded to the stitching yarn.

Further features and advantages of the invention will be described in reference to the detailed description and examples which follow.

DESCRIPTION OF PREFERRED EMBODIMENTS

Figure 1:
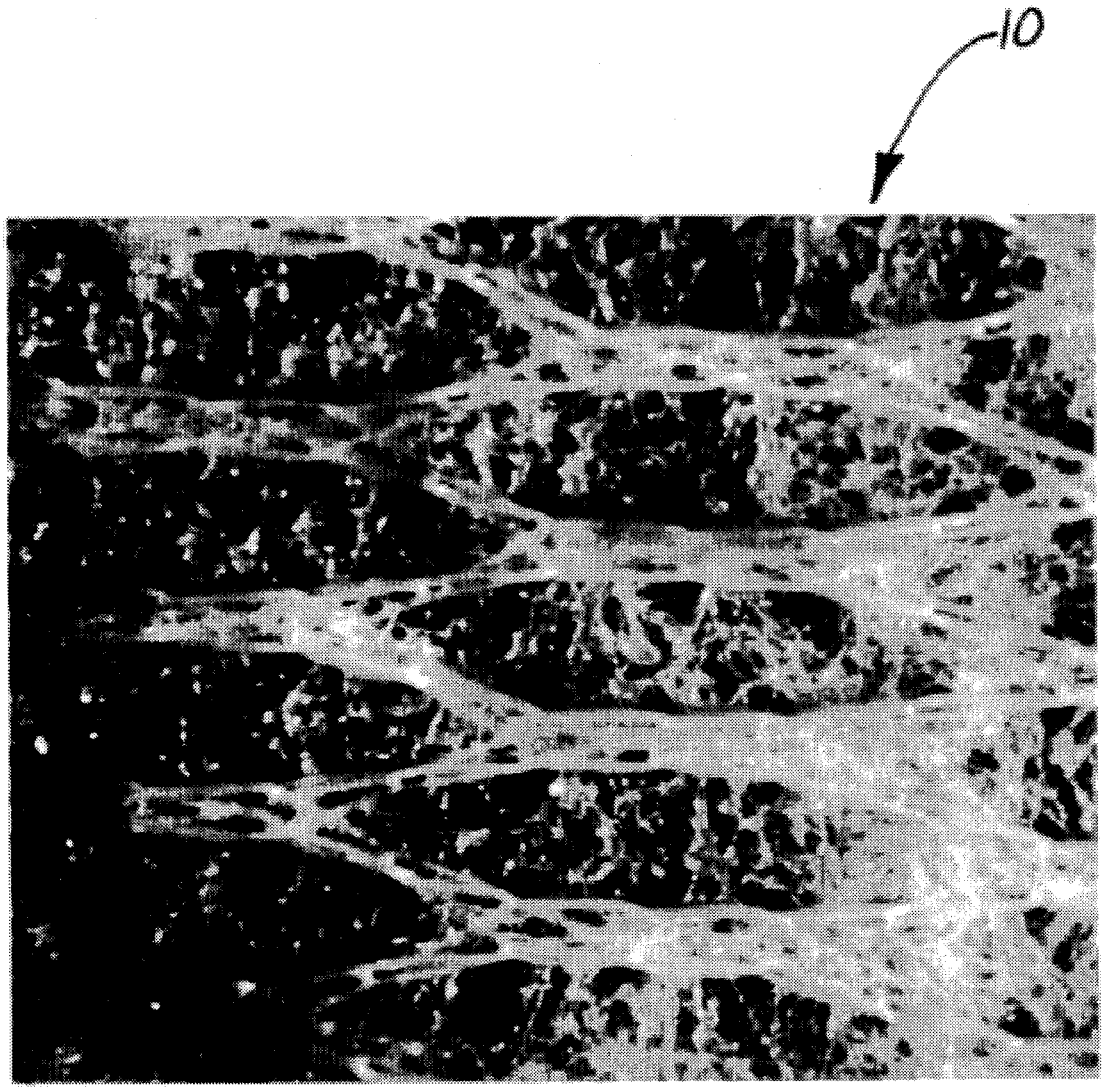
FIG. 1 is a scanning electron micrograph (3× magnification) of a preferred scrubbing article within the invention.

As previously noted, in dual purpose absorbent scrubbing article embodiments in accordance with the invention, the first layer of material preferably comprises a batt of nonwoven cellulosic pulp fibers bonded together by an adhesive binder, the batt having a basis weight of at least about 95 grams/m$^2$ (gsm) per ply. Absorbent materials such as these are hydrophilic in nature, and more than one batt can be included in an absorbent layer. Another preferred absorbent material is blown microfibers such as blown polypropylene microfibers, which are typically hydrophobic. A combination of hydrophobic and hydrophilic fibers may be used in absorbent materials useful in the invention.

Given that absorbent materials useful in the articles of the invention may comprise hydrophobic and hydrophilic fibers, dual purpose absorbent/scrubbing articles of the invention may be water absorbent, oil absorbent, or both, are very durable, and yet are inexpensive to produce. Particularly, if the absorbent fibrous sheet is made from 100% cellulosic pulp fibers, the dual purpose articles of the invention are low in cost compared with articles based on synthetic wood pulp fibers, even with the addition of scrubbing nodules. Articles which include a layer of 100% viscose rayon, cotton, or sponge material (cellulose or polyurethane) opposite the scrubbing surface are similarly relatively inexpensive to produce.

The adhesive binder of the batt(s) of cellulosic pulp fiber may comprise any of the commonly used adhesive binders known in the art. Typically and preferably the adhesive binder comprises a copolymer of ethylene and vinyl acetate, wherein the vinyl acetate is present at about 10 to about 20 weight percent of the copolymer. Cellulosic wood pulp batts having this adhesive and found useful in the invention include those known under the trade designation "Airtex", from James River Corporation, especially product numbers 395 and 399. The 399 version is more absorbent but less strong than the 395 version. Although the composition of these batts is proprietary, it is believed the adhesive generally comprises from about 2 to about 20 weight percent of the adhesive bonded cellulosic pulp fiber batts. Other cellulosic absorbent materials useful in the articles of the invention include materials known under the trade designation "Walkisoft", especially product numbers FG 407-SHB, FG 412-SHB, and FG 404-SHB, where "SHB" designates "super high bulk."

The second surface of the absorbent material, i.e., the surface opposite the scrubbing surface, may have adhered thereto by stitch bonding materials selected from the group consisting of i) a second batt of nonwoven cellulosic pulp fibers bonded together by an adhesive, the second batt being the same as or different from the first batt, and ii) a woven, nonwoven, or knitted layer of materials selected from the group consisting of viscose rayon, cotton, non-polyolefin synthetic fibers, and mixtures thereof.

Alternatively, the second surface may have meltbonded thereto thermoplastic nodules similar to or different than those nodules on the first surface of the absorbent layer. A further variation is that after stitchbonding is completed, one or more of the materials in i) and ii) of the immediately preceding paragraph, or a porous material such as cellulose or polyurethane sponge, may be adhered to the stitchbonded article using adhesives, melt-bonding and the like. In these latter "laminate" embodiments, if the open, porous material is a cellulosic sponge, the preferred method of attachment is the use of a moisture-curable polyurethane adhesive, while if the porous material is polyurethane-based, an isocyanate-curable polyurethane is preferred.

If the second layer is viscose rayon, this layer is preferably nonwoven, more preferably spunlaced nonwoven. Suitable spunlaced 100% viscose rayon materials are available from various commercial sources. One spunlaced 100% viscose rayon material found useful for the purposes of this invention is that sold under the trade designation "Brand 6411 Apertured," from Scott Paper Company.

The stitchbonded layers of the dual purpose articles are stitched through using a stitch density (stitches per 10 cm in machine direction) ranging from about 15 to about 50 st/10 cm, more preferably ranging from about 20 to about 35 st/10 cm.

The stitch gauge (number of vertical lines of stitches (wales) per 10 cm in cross direction) ranges from about 10 to about 40, preferably from about 13 to about 28 gauge, more preferably about 20 gauge.

Stitching densities and gauges outside of these ranges, especially when used with embodiments having no viscose rayon layer, are not preferred since in some constructions the durability, absorbency, and scrubbing properties may not be optimized. For example, stitchbonded articles having stitch density greater than about 50 st/10 cm were found to have reduced water absorbency rate and total water absorbency values. Stitchbonded articles of the invention having stitch density less than about 15 st/10 cm were found to exhibit reduced durability. However, as some users may prefer articles constructed with stitch densities and stitch gauges outside of the preferred ranges, these articles are not considered outside the scope of the invention.

Acceptable water (oil) absorbency for dual purpose articles within the invention is determined by laying the article on a water-covered (oil-covered) surface and allowing the water (oil) to be absorbed into the article. If more than about 50 weight percent of the water (oil) as a percentage of the total weight of water (oil) is absorbed by article, the article is deemed to have acceptable water (oil) absorbency.

All articles within the invention have at least one surface which has scrubbing capability. To be acceptable and thus within the invention, an article preferably removes a standard baked on food soil in a standard food soil removal test (described in the Test Method section) at a rate which is at least 50 percent higher than articles not having scrubbing, nodule-containing surfaces. More preferably and typically the scrubbing effectiveness is at least 100 percent, more preferably 1000 times articles not having scrubbing nodules.

Dual function articles of the invention having stitch gauge of above about 50 may exhibit decreased absorbency due to higher degree of compression of the absorbent layers. This is especially true for cellulosic pulp fiber layer(s). Thus, stitching gauges higher than about 50 are not advantageous for stitching prebonded cellulosic pulp based nonwoven layers due to excessive perforation by the stitching needles, resulting in diminished original tensile strength and integrity of the absorbent cellulosic pulp layer(s). However, if one desires to shift the balance of absorbency and scrubbing performance toward scrubbing ability, higher stitch gauges may be advantageous, since the perforations caused by the stitching needles results in raised areas on the technical backside of the dual function articles, resulting in a more aggressive scrubbing action.

Figure 6:
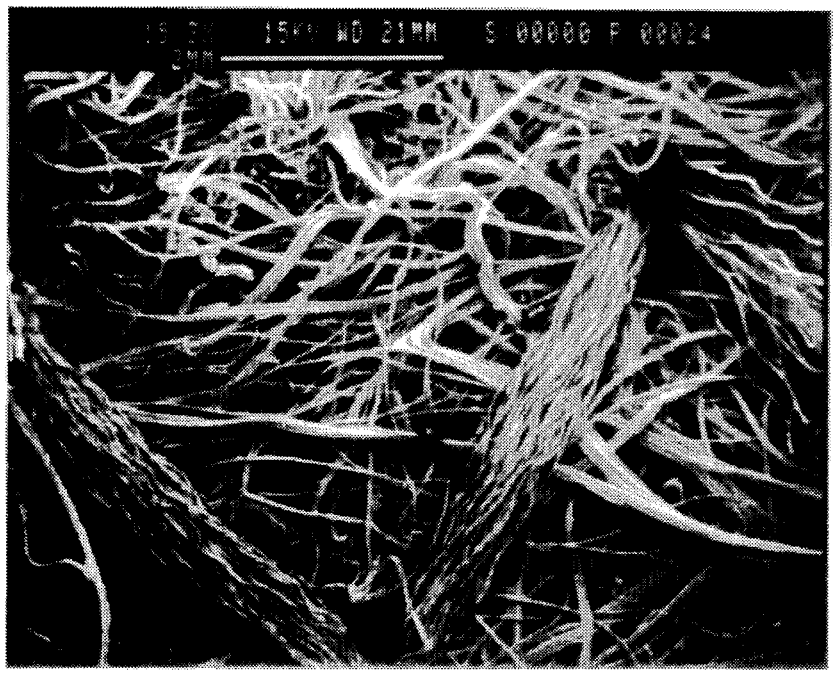
FIG. 6 is a scanning electron micrograph (15× magnification) of a precursor of a dual purpose article before heat treatment.
Figure 7:
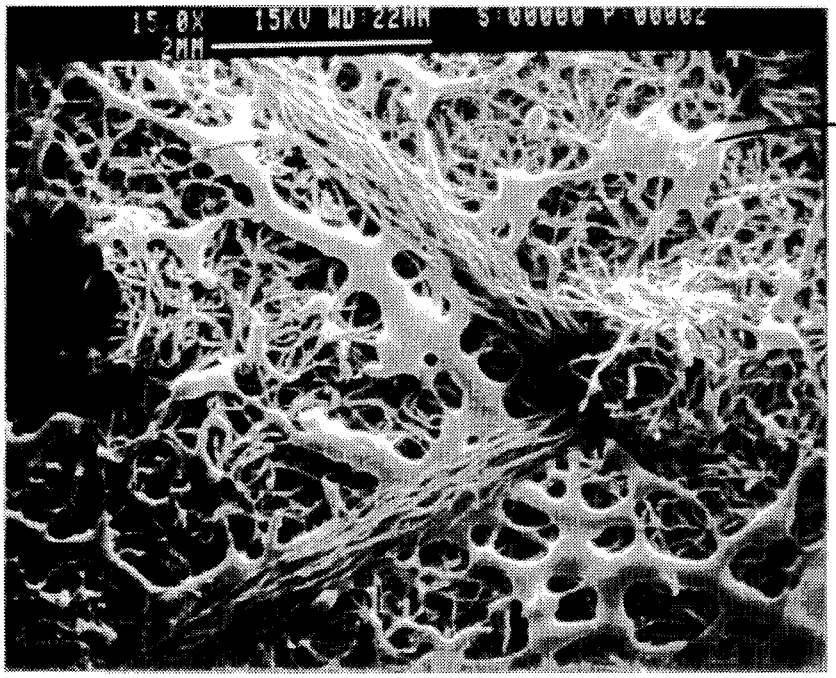
FIGS. 7 is a scanning electron micrograph (15× magnification) of the precursor of FIG. 6 after heat treatment.

The thermoplastic nodules which are melt-bonded to the articles of the invention must be made of a material having a melting point which is less than the melting or decomposition temperature of the absorbent layer (in the case of dual purpose articles) and at least a portion of the stitching yarn. The shape of individual nodules is quite random. FIG. 6 shows a scanning electron micrograph (15× magnification) of a precursor of a dual purpose article before heat treatment, and FIG. 7 is a scanning electron micrograph, also 15× magnification, of the article of FIG. 6 after heat treatment, showing the random shape of the thermoplastic nodules (in this case polypropylene). The nodules also are quite random in size, ranging from elongate river-like nodule to smaller, island-like nodules.

The thermoplastic nodules of the invention are formed by first stitchbonding a thermoplastic layer onto to the absorbent layer (in the case of dual function articles) or stitching through only a thermoplastic layer of material. The thermoplastic layer is then contacted with a heated roller or other heating means to effectuate melting of the thermoplastic material. Commercial examples of preferred thermoplastic materials which may be used as precursor materials for the nodules include the spunbonded polypropylene webs known under the trade designation "RFX", especially type 5000, available from Amoco Chemical Company, Inc.; a fibrillated film mesh/scrim fabric, sometimes referred to as a cross-laminated airy fabric (CLAF) of polyethylene, such as that available from Amoco Niseki, Inc. under the trade designation "MS"; various extruded mesh polyolefin fabrics such as that available from Conwed, Inc. under the trade designation "ON6270"; fibrillated polyolefin fiber webs known under the trade designation "Filtrete", available from Minnesota Mining and Manufacturing Company ("3M"), St. Paul, Minn., under the trade designation "G-01"; and carded, air-laid, staple fiber polyolefin webs, especially polypropylene, available from various commercial sources.

As mentioned previously, a yarn comprising at least two compositionally different types of fibers having different heat stability which can be at least partially melt-bonded together may be used, in which case the yarn is also capable of melt-bonding to at least a portion of the article outer surfaces.

If bicomponent yarn is used, the yarn preferably comprises a first fiber having a melting temperature below that of the absorbent material but no greater than about 175° C., and a second fiber having a melting temperature of at least about 200° C., more preferably at least about 240° C.

The portion of the yarn having a melting temperature below that of the absorbent material but no greater than about 175° C. may be a polyolefin selected from the group consisting of branched polyethylene, linear polyethylene, polypropylene, and mixtures thereof. Particularly preferred is polypropylene, which has a melting temperature range of about 160°–170° C. The denier (i.e., fineness) of these fibers should be such as to allow sufficient bonding between the higher melting temperature fibers of the yarn and the cellulosic or other absorbent layer material outer surfaces. Otherwise, the denier of these fibers is not critical, and may range from about 40 to about 200 denier, more preferably from about 70 to about 100 denier. Fiber deniers lower than about 40 are difficult to melt-bond simply because there is less mass of the fiber.

The second fiber having a melting temperature of at least about 200° C. may be chosen from polyester (polyethylene terephthalate melts at about 248° C.), alpha-cellulose (cotton) and rayon (which decomposes after long exposure to temperatures of about 225° C.), protein, acetate, fluorocarbon, polyacrylonitrile, polyamide (the various nylon polyamides melt at about 220° C.), staple fiber spun yarns comprising viscose rayon or cotton, and mixtures thereof.

Particularly preferred as the second fiber is polyethylene terephthalate (PET) polyester. These fibers have the advantage of drawing water toward the absorbent layer in the case where viscose rayon is attached to the non-scrubbing surface of the dual function article embodiments. The interconnected network of the PET stitches through the layers of the articles of the invention increases the strength of the articles.

The denier of the second fiber is also not critical, and may range from about 10 to about 400 denier, more preferably from about 120 to about 180 denier. Fibers having lower denier than about 70 are presently not preferred as they may be too weak in tensile strength; however, should fibers having denier less than 70 become available which provide the requisite strength to the articles of the invention, these may also be used. Fiber deniers above about 400 are generally not required for increasing the durability of the articles of the invention beyond the point where the user would normally dispose of the article. Larger denier fibers are also more expensive.

A particularly preferred dual purpose article within the invention comprises a batt of cellulosic pulp fibers known under the trade designation "Airtex" 399 (James River Corporation) stitchbonded to a spunbonded polypropylene web known under the trade designation "RFX" 5000 (Amoco Chemical Company, Inc.), stitched through using a bicomponent yarn comprising 30 weight percent 80 denier polypropylene, 70 weight percent 150 denier polyethylene terephthalate. This article preferably has a stitch density of 30, stitch gauge of 20 (both as measured on the stitchbonding machine), using a plain stitch pattern, with the thermoplastic nodules formed either on the technical back side or technical face side.

One preferred embodiment 10 of a scrubbing article is illustrated in FIG. 1. In this embodiment, a layer of material comprising randomly laid 70 weight percent polypropylene, 30 weight percent polyethylene terephthalate (PET), available from 3M under the trade designation "Thinsulate" C-100, was stitched through using a 100 weight percent, 90 denier PET yarn, threading the yarn in two lapping bars in 1:1 threading order in each bar, providing the open mesh hexagonal structure as illustrated. When the stitched web was heated with forced hot air at a temperature between the melting temperature of polypropylene and PET (about 200° C.) and subsequently cooled, the polypropylene formed nodules which appear as agglomerates attached to the PET fibers. As seen in FIG. 1, a special hexagonal pattern was created on the technical face side of the article, and offset rows of raised and lowered areas on the technical back side. The polypropylene fibers in the original web were converted into hardened nodules after cooling, the nodules being arranged in a pattern configuration which followed the knit structure, thus creating the three dimensional scrubbing surface illustrated in FIG. 1.

The scrubbing article illustrated in FIG. 1 may be attached (for example glued, melt-bonded) to a cellulosic or polyurethane porous material, as previously described, with the scrubbing surface (technical face side) exposed. Scrubbing articles may be attached to both sides of a sponge in this manner, or a "pillow case" arrangement may be produced, wherein one scrubbing article of the invention is enclosed around a porous material. Alternatively, two scrubbing articles of the invention (or one within the invention and one outside the invention) may be placed on either side of the porous material, thus enclosing the porous material, and the mating the peripheral edges of the scrubbing articles attached together, such as by stitching, melt-bonding, gluing and the like. As used herein the term "enclosed" simply means that the scrubbing article surrounds the porous material. The scrubbing article of the invention may be attached to the porous material or not attached.

A dual purpose article was constructed similarly to the scrubbing article construction illustrated in FIG. 1. In the dual purpose embodiment, an absorbent material layer, such as a layer of 100% viscose rayon staple fibers, was stitched through using yarn threading in two lapping bars in 1:1 threading order in each bar, providing the open mesh structure. The absorbent material layer was a carded web having weight of about 120 grams per square meter (gsm).

Thermoplastic nodules were formed from a layer of 100% polypropylene melt-blown fibers known under the trade designation "Thinsulate". The two layers were stitched together using 90 denier polyester multifilament yarn on the Malimo stitchbonding machine. As in the scrubbing article illustrated in FIG. 1, the stitching yarns were incorporated through these two layers in a special pattern which created the hexagonal pattern on the technical face side of the article and offset rows of raised and lowered areas on the technical back side. The stitched article of this embodiment had the thermoplastic nodules on its technical face side, but they could have easily been attached to the technical back side. The technical face side was heated to the melting temperature of the polypropylene microfibers then converted into hardened nodules after cooling, the nodules being arranged in a pattern configuration which followed the knit structure, thus creating a three dimensional scrubbing surface similar to that illustrated in FIG. 1.

Figure 2A:
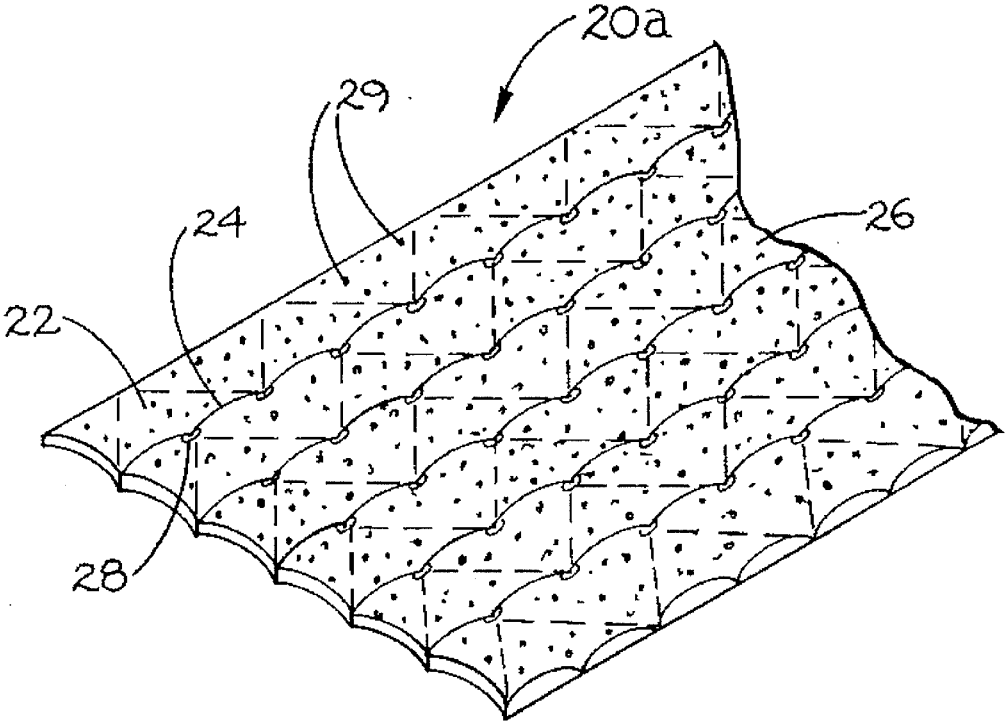
FIGS. 2*a*, 2*b*, 3 and 4 illustrate perspective schematic views of dual purpose articles within the invention.
Figure 2B:
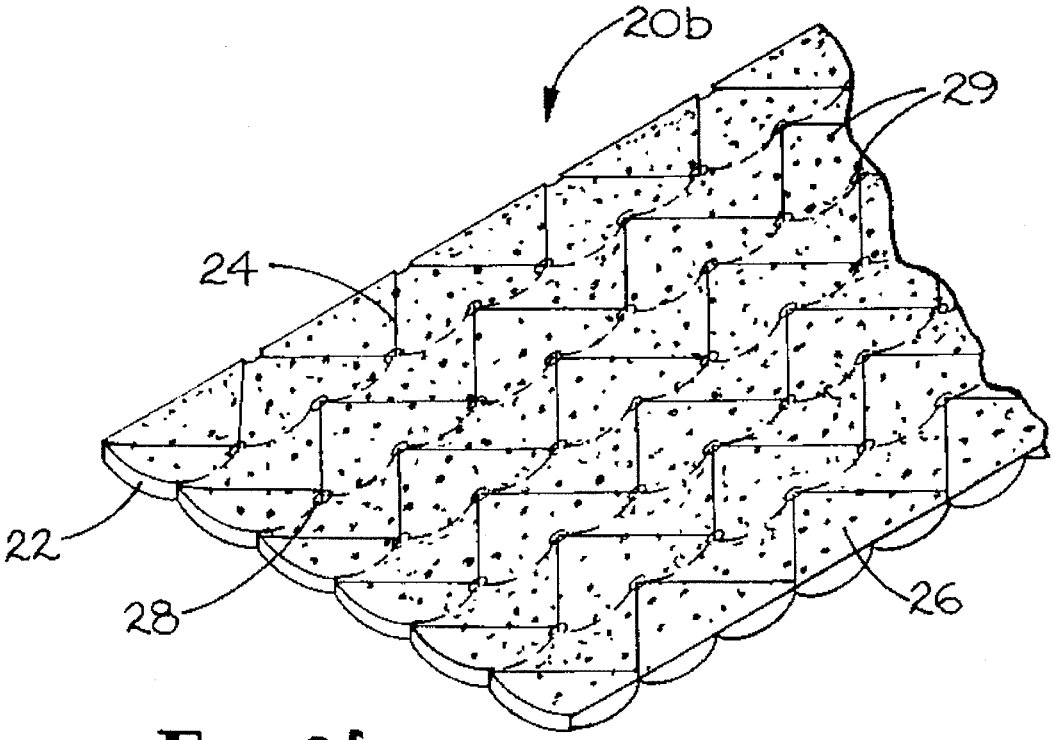

Two other preferred dual purpose article embodiments 20*a* and 20*b* of the invention are illustrated in perspective schematic views in FIGS. 2*a* and 2*b*, respectively. In these embodiments, a layer 22 of a batt of adhesive bonded cellulosic pulp fibers (such as those sold under the trade designations "Airtex" or "Walkisoft", as previously mentioned) were stitched through using stitching yarn 24. The cellulosic nonwoven had a weight of about 100 gsm and formed the technical backside of the fabric, and the nodules were formed from a layer of 100% polypropylene nonwoven fabric having a weight of about 51 gsm (spunbonded polypropylene) on the technical face side 26. Technical face side 26 of article 20*a* is shown on top, showing the preferred "plain" stitch pattern of stitching yarn 24 used in the articles of the invention. The technical backside of embodiment 20*a* is illustrated by the dashed lines. The technical backside 26 of embodiment 20*b* is illustrated in FIG. 2*b* on top.

As seen in FIGS. 2*a* and 2*b*, needle perforations 28 are illustrated slightly exaggerated in size to emphasize the point where individual needles have penetrated absorbent layer 22. Alternatively, absorbent layer 22 may be a nonwoven mixture of rayon/non-polyolefin synthetic fibers, or, more preferably, 100% cellulosic fibers. Higher than about 30 weight percent polyolefin or polyolefin synthetic fibers may not be preferred due to the decrease in water absorbency of the articles of the invention. However, if an oil absorbent article is desired, of course, the use of synthetic hydrophobic absorbent fibrous layers may be preferred. Suitable nonpolyolefin synthetic fibers include polyester, acrylic, polyamide, and the like, while suitable polyolefins include polyethylene, polypropylene, and the like.

Article 20*a* of FIG. 2*a* further comprises thermoplastic nodules 29 melt-bonded to the technical face side 26 of absorbent layer 22. In this embodiment, nodules 29 are only on the technical face side of the article. Embodiment 20*b* of FIG. 2*b* the nodules are only on the technical backside.

Figure 3:
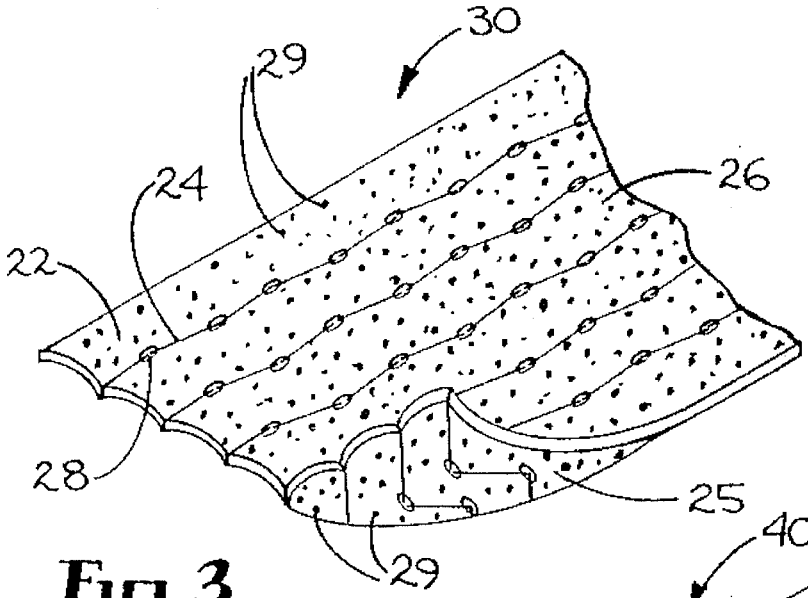

FIG. 3 illustrates in perspective another dual purpose embodiment 30, with one corner of the article raised to expose the technical back side 25. Embodiment 30 is similar to embodiment 20*a* illustrated in FIG. 2a, except that embodiment 30 includes thermoplastic nodules 29 on both technical back side 25 and technical face side 26.

Figure 4:
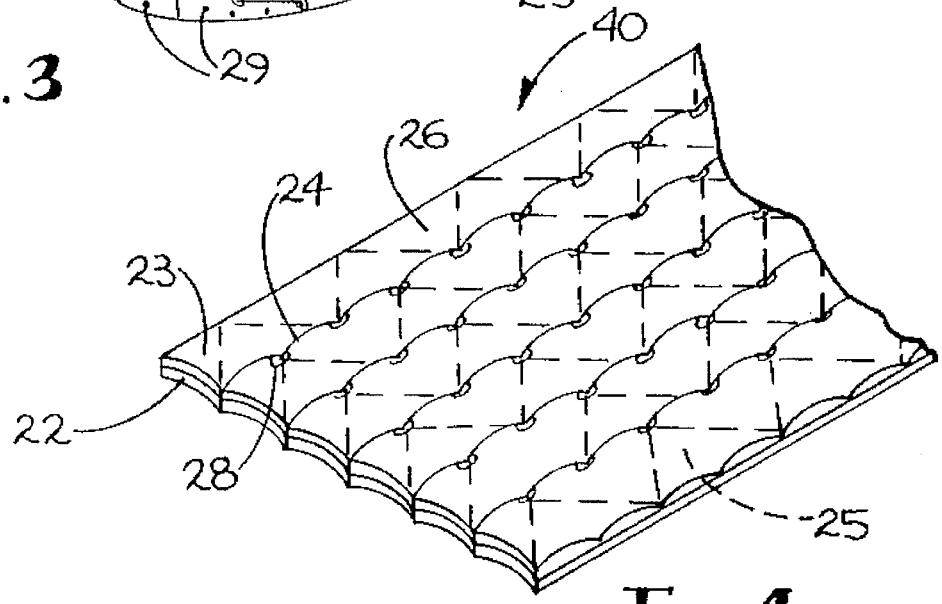

FIG. 4 illustrates embodiment 40, again in a perspective schematic view, which is a single layer of absorbent cellulosic pulp fibers 22 stitchbonded to a spun-laced 100% viscose rayon layer 23 on its nonscrubbing technical face side 26, with thermoplastic nodules 29 formed on the technical back side 25 (dashed lines). A plain stitch was used of yarn 24 similar to as described in reference to the previous embodiments.

Figure 5:
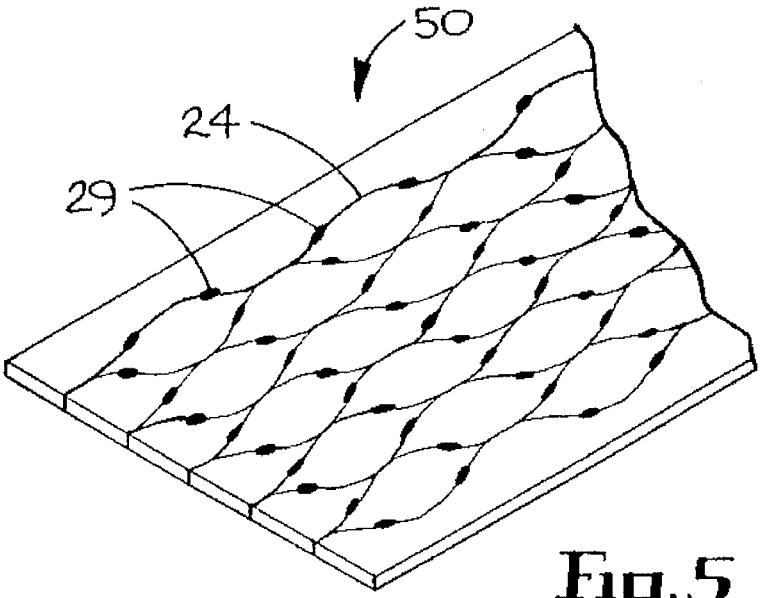
FIG. 5 illustrates a perspective schematic view of another preferred scrubbing article within the invention.

FIG. 5 illustrates embodiment 50 of a scrubbing article within the invention comprising stitches of yarn 24 having nodules 29 adhered thereto. This embodiment is essentially the equivalent of that illustrated in FIG. 1 but without absorbent layer 12. Thus, the thermoplastic nodules are melt-bonded only to the yarn. This scrubbing article may also be attached to a porous material as discussed with reference to the scrubbing article illustrated in FIG. 1.

The method of manufacturing stitchbonded dual use articles of the invention comprises contacting an absorbent layer with a low-melting layer and then forming an intermediate stitchbonded article having a stitch density ranging from about 15 to about 35 st/10 cm, and stitch gauge ranging from about 10 to about 40 wales/10 cm, using a plain or tricot stitch. Stitchbonding machines known under the trade designations "Maliwatt", "Malimo" and "Arachne" are adequate for these purposes. Single or multicomponent yarns may be used, with a yarn as described above comprising first and second fibers of different heat stability being preferred. If such a bicomponent yarn is used it preferably comprises 80 denier polypropylene and 150 denier polyester.

After forming the intermediate stitchbonded article, the surface of the stitchbonded article having the thermoplastic layer is heated for a time and at a temperature sufficient to melt the thermoplastic layer having lower melting temperature but insufficient to melt the absorbent layer and at least a portion of the yarn. This procedure causes melting of at least a portion of the lower melting layer to form globules of molten polymer which adhere to the absorbent layer and higher melting fibers of the yarn. Upon cooling, the thermoplastic material hardens and becomes melt-bonded to the outer surface of the cellulosic pulp or viscose rayon layer, depending on the layer used. The stitchbonded, nodule-bearing web thus formed is then ready to be cut into individual dual purpose articles of the invention.

The heating and cooling cycle may also cause shrinkage of the entire construction by virtue of the shrinkage of high-melting yarn components, such as PET. In other words, a web stitchbonded with PET yarn may have an initial web width which is greater than the web width after heating and cooling. Thus, an advantage of the invention is that the bulkiness of the articles of the invention may be adjusted not only by the web precursors, but by the choice of stitching yarn. By use of appropriate heating and cooling conditions, the intermediate stitchbonded article may be made to shrink in its width direction, allowing the formation of vertical peaks between stitch wales to bulge upright and create three dimensional ribs parallel to the stitch wales, thus providing a scrubbing surface with tunnel-like shape profile.

One method of heating the stitchbonded article to cause melt-bonding of the thermoplastic layer to occur is by first contacting the intermediate stitchbonded article to a series of perforated or screen drums which are designed to have heated gas passed therethrough (air of relative humidity below about 70% being the preferred gas). The stitchbonded fabric is typically and preferably passed on the top side of one drum and the bottom side of the next succeeding drum in known fashion. Heated air or other gas is drawn through the intermediate stitchbonded article and the perforations or screen of the drums by reducing the pressure on the inside of the drums in a manner which maintains the loft of the layer but is just sufficient to keep the layer in contact with the drum. For this method, the time sufficient to cause the melting to occur varies with the temperature of the heated air. Typically, if the temperature ranges from about 200° to about 210° C., the time ranges from about 15 to about 25 seconds. It is important to keep the time required at a minimum as the nonwoven cellulosic pulp materials may begin to oxidize slightly (turn mildly yellow) if time at temperature is too long.

Other methods of heating the stitchbonded intermediate article, may be used, such as passing the stitchbonded intermediate article through an open, heated passage having air circulation without drums, as for example in a tenter frame dryer. Tenter frame dryers are well known in the art. Alternatively, the low melting thermoplastic side of the stitchbonded intermediate article may be passed over a heated metal roller or series of heated metal rollers, and subsequently contacted with one or more cooled metal rollers or other cooled surface to allow formation of thermoplastic nodules.

If a single component yarn is used for stitching, the yarn may comprise PET, polyamide, or cotton, with the proviso that stitch raveling may be a problem. The raveling problem is solved by melting the thermoplastic layer onto the absorbent layer, which locks the stitches to the absorbent layer when the nodules are formed.

In testing the scrubbing effectiveness of the dual purpose and scrubbing articles of the invention, a Schiefer abrasion test was used. This test simulated the removal of baked-on food soil from a panel under laboratory controlled conditions. The panels were prepared after coating each with a known amount of standard food soil composition and then baked for 30 minutes at 191° C. (three coats of the food soil composition were applied). Briefly, the test consists of monitoring weight loss from the panel after the coated side of the baked food soil panel has been rubbed against the scrubbing surface of the test sample. A higher weight loss from the panel for a given number of cycles of the abrasion test machine is an indication of a greater scouring effectiveness. Typically the scrubbing sides of the samples, such as that shown in FIG. 2, gave a much greater weight loss from the panel as compared to the "smooth" non-nodule-bearing side of the sample. Typically and preferably the scrubbing side will remove about 50% more food soil, more preferably about 500% more food soil, than that removed by the non-nodule-bearing side of the article.

The articles of the invention will now be described with reference to the following Examples wherein all percentages and parts are by weight unless otherwise specified.

EXAMPLES

The dual function and scouring articles formed in the Examples which follow were tested to determine their effectiveness in removing a standard burned-on food soil from a round stainless steel panel. A measured amount of a standard food soil composition was coated onto stainless steel panels and baked at 191° C. for 30 minutes. All the panels were alternately coated and baked 3 times in this manner.

10.16 cm diameter stainless steel panels were coated using the standard food soil as follows. An oven was preheated to 191° C. Meanwhile, a panel to be coated was placed on a scale and 2 grams of food soil composition was placed on the panel. The panel was carefully removed from the balance and placed on a flat surface. A coating rod known under the trade designation "RDS #60" was then used to spread the food on the panel, then the coating rod pulled (not rolled) across the panel so that the food soil covered the entire panel with a uniform coating of food soil.

Coated panels were then placed on a flat metal sheet and the sheet placed in the preheated oven for 30 minutes at 191° C. After 30 minutes the panels were removed from the oven and allowed to cool to room temperature.

Second and third food soil coatings were formed on the panels over the first coating exactly as described for the first coating (i.e., coating, baking, cooling for the second coating and similarly for the third coating). The coated panels were then allowed to cool to room temperature for 24 hours.

The previously prepared food soil-coated panels were then weighed to the nearest 0.01 gram and this weight recorded as "Mi". The preweighed food soil-coated panel to be scoured and the Example dual purpose article to be tested were placed in opposed holders of an abrasion machine known under the trade designation "Schiefer Tester". This machine consisted essentially of two horizontal, spaced apart holders, the upper holder adapted to rotate a set number of revolutions under a constant load. For each Example article tested the machine was set so that the upper holder rotated 600 revolutions while abrading the test panel. After the 600 revolutions were complete, the test panel and Example article were removed from the machine, and the test panel placed in an oven for 30 minutes at 80° C. to dry. The panel was then removed from the oven, allowed to cool to room temperature (about 20° C.), and weighed to the nearest 0.01 gram, this weight being recorded as M2. To calculate the scouring effectiveness, M2 was subtracted from M1. A greater weight difference indicated a better scouring effectiveness.

Four dual function Example articles within the invention were made for evaluation. The composition and construction of Examples 1, 2a, 2b, and 3 are summarized in Table 1.

TABLE 1

| | Example Constructions* | | | | | | |
|---|---|---|---|---|---|---|---|
| | Example Construction | | | | | | |
| Example | AM | # AM | GA | YT | SD | ST | NFM |
| 1 | VR | 1 | — | PE | — | WKOM | MBPP |
| 2a | 399 | 1 | 20 | PE/PP | 30 | PS | SBPP (TF) |
| 2b | 399 | 1 | 20 | PE/PP | 30 | PS | SBPP (TB) |
| 3 | WKSFT | 1 | 20 | PE/PP | 30 | PS | SBPP (TB) |

*In Table 1 the following definitions apply:
"AM" = absorbent material;
"# AM = number of absorbent layers;
"NFM" = nodule forming material;

"GA"=stitch gauge (needles per 10 cm, cross direction, as measured on the machine);

"SD"=stitch density (stitches per 10 cm, machine direction, as measured on the machine);

"YT"=stitching yarn type;

"399"=the ethylene/vinyl acetate adhesive bonded cellulosic pulp fiber batt known under the trade designation "Airtex" from James River Corporation;

"WKSFT"=the cellulosic pulp fiber batt known under the trade designation "Walkisoft" FG-407-SHB, available from Walkisoft Corporation;

"PE"=polyester;

"VR"=viscose rayon;

"MBPP"=melt-blown polypropylene;

"SBPP"=spun-bonded polypropylene;

"ST"=stitch type;

"PS"=plain stitch;

"WKOM"=warp knit open mesh;

"TF"=technical face side;

"TB"=technical back side.

The dual function article of Example 1 was comprised of an absorbent layer which was a carded web made of 100% viscose rayon staple fibers having a weight of about 120 gsm, and one layer of 70 weight % polypropylene/30 weight % PET staple fibers known under the trade designation "Thinsulate" type C-100 available from 3M Company, St. Paul, Minn. The two layers were stitched together on a Malimo stitching machine using 90 denier polyester multifilament yarn. The stitching yarns were incorporated through these two layers in a special pattern which created the surface structural configuration similar to that illustrated in FIG. 1 simulating the hexagonal pattern on the technical backside of the article, with offset locations of raised and lowered areas on the technical face side. This surface structural configuration was achieved by stitching with yarn threading in two lapping bars in 1:1 threading order in each bar, providing the warp-knit open mesh structure. The stitched fabric having the low melting point fiber layer on its technical face side was heat treated on a through-air drum dryer with air at a temperature of 204° C., with a dwell time of 20 seconds on the drum to obtain melting of the polypropylene fibers, and then air cooled to form hardened nodules of polypropylene, thus creating the scrubbing surface of the dual purpose article. The viscose rayon fiber layer on the other side of the article of Example 1 provided the absorbency and wiping effect.

Examples 2a and 2b correspond to FIGS. 2*a* and 2*b*, respectively, and differ only in the location of the polypropylene nodules, Example 2a having the nodules on the technical face side, Example 2b having the nodules on the technical back side. The absorbent layer for Examples 2a and 2b each utilized the same absorbent layer and polypropylene layers. The absorbent layer was the cellulosic air-laid nonwoven known under the trade designation "Airtex" 399 from James River Corp., having a weight of about 100 gsm. The polypropylene nodules in Examples 2a and 2b were derived from a layer of 100% polypropylene spun-bonded nonwoven fabric known under the trade designation "Celestra" from Fiberweb, which weighed about 51 gsm.

The article produced as Example 3 was produced using a cellulosic pulp fiber absorbent material known under the trade designation "Walkisoft" FG 407-SHB, having a weight of about 97 gsm. The polypropylene nodules were derived from a layer of 100% polypropylene spun-bonded nonwoven fabric known under the trade designation "RFX" 5000, from Amoco Chemical Company, Inc., which weighed about 25 gsm.

The stitchbonding for Examples 2a, 2b and 3 was performed on an Arachne machine, using a stitching gauge of 40 with needle casting in order 1:1 (spacing of 5 millimeters) using a plain stitch, and stitch density of 30 stitches per 10 cm. The stitching yarn was a bicomponent yarn consisting of 150 denier polyester and 90 denier polypropylene. The stitched fabric was heat treated on a through air drum dryer with air at a temperature of 204° C., with a dwell time of 20 seconds on the drum. During the heating process the article shrunk in the width direction, forming vertical upraised ribs between the stitch wales on the technical face side.

Each of dual purpose articles of Examples 1, 2a, 2b, and 3 were tested using the scouring test method described above. Each of the articles of Examples 1, 2a, 2b, and 3 was tested using the nodule-bearing surface, and each removed food soil from the test panels. In addition, Example 2a was tested for scrubbing effectiveness on both its nodule-bearing technical face side and its non-nodule bearing technical backside. The nodule-bearing technical face side produced a weight loss of 0.1 gram from its test panel, while the non-nodule bearing technical backside caused less than 0.01 gram weight loss from a test panel.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making a scrubbing article having first and second major surfaces, the method comprising:

(a) stitching together a sheet of an absorbent material and a sheet of a thermoplastic material with a stitching yam at a stitch density and stitch gauge, said thermoplastic material having a melting temperature less than the melting temperature of said absorbent material, said stitching yarn comprising a first component and a second component, said first component having a melting temperature less than the melting temperature of said second component;

(b) heating the product of step (a)to a temperature sufficient to melt said first component and said thermoplastic material but insufficient to melt said absorbent material and said second component; and (c) forming a scouring surface on at least one of the major surfaces of the article by cooling the product of step (b) to reharden said first component and said thermoplastic material, said scouring surface comprising a plurality of hardened nodules bonded to said absorbent material and to said stitching yarn.

2. The method as defined in claim 1 wherein said first component comprises fibers of a polyolefin selected from the group consisting of polyethylene, polypropylene and combinations thereof.

3. The method as defined in claim 1 wherein said first component has a fineness within the range from about 40 to about 200 denier.

4. The method as defined in claim 1 wherein said second component comprises fiber selected from the group consisting of polyester, cotton, rayon, protein, acetate, fluorocarbon, polyacrylonitrile, polyamide, and combinations thereof.

5. The method as defined in claim 4 wherein said polyester is polyethylene terephthalate.

6. The method as defines in claim 1 wherein said second component has a fineness within the range from about 10 to about 400 denier.

7. The method as defined in claim 1 wherein said absorbent material is a nonwoven cellulosic batt comprising cellulosic pulp fibers bonded together, said pulp fibers selected from the group consisting of cotton, rayon and wood pulp.

8. The method as defined in claim 7 wherein said pulp fibers are bonded together with an adhesive binder.

9. The method as defined in claim 7 wherein said absorbent material further comprises a thermoplastic material bonding said pulp fibers to one another.

10. The method as defined in claim 1wherein said absorbent material comprises hydrophilic materials, or hydrophobic materials or combinations of hydrophilic and hydrophobic materials.

11. The method as defined in claim 10 wherein said hydrophobic material comprises blown polypropylene microfibers.

* * * * *